United States Patent [19]

Rokicki

[11] Patent Number: 4,726,145

[45] Date of Patent: Feb. 23, 1988

[54] SLIDING DOOR ASSEMBLY

[76] Inventor: Stanley Rokicki, 112 Lake Promenade, Toronto, Ontario, Canada, M8W 1A4

[21] Appl. No.: 49,834

[22] Filed: May 15, 1987

Related U.S. Application Data

[63] Continuation of Ser. No. 870,956, Jun. 5, 1986, abandoned.

[51] Int. Cl.[4] ..... E05D 15/10

[52] U.S. Cl. ..... 49/220

[58] Field of Search ..... 49/223, 220, 219, 218, 49/123

[56] References Cited

U.S. PATENT DOCUMENTS

| | | | |
|---|---|---|---|
| 376,946 | 1/1888 | De Vry et al. | 49/123 |
| 736,357 | 8/1903 | Brousseau | 49/123 |
| 1,300,475 | 4/1919 | O'Connor | 49/220 |
| 2,992,462 | 7/1961 | Gutridge | 49/220 |
| 3,660,938 | 5/1972 | Ross, Jr. et al. | 49/220 |
| 4,317,312 | 3/1982 | Heideman | 49/220 |
| 4,384,429 | 5/1983 | Rokicki et al. | 49/219 X |

FOREIGN PATENT DOCUMENTS

| | | | |
|---|---|---|---|
| 8203515 | 4/1984 | Netherlands | 49/220 |

*Primary Examiner*—Philip C. Kannan

*Attorney, Agent, or Firm*—Donald E. Hewson

[57] ABSTRACT

A sliding patio door assembly is disclosed of the kind in which the door, when it is being closed, moves bodily laterally with respect to the slide track; i.e., forwardly with respect to the closing door panel. When fully closed, the door is entered into a recess, and a weather seal is compressed between the door and a lip surrounding the recess. The door is controlled, as to its lateral movement relative to the slide track, upon crank arms, and it is a feature of the disclosure that the crank arms are constrained to pivot in unison but in opposite senses of rotation. Another feature is that the crank arms lie at 90 degrees to the line of the slide track when the door is fully closed.

10 Claims, 6 Drawing Figures

SLIDING DOOR ASSEMBLY

CROSS REFERENCE

This is a continuing application of Ser. No. 870,956 filed June 5, 1986, now abandoned.

FIELD OF THE INVENTION

This invention relates to a manner of arranging for a door, such as a heavy glass patio door, to slide from an open to a closed position.

BACKGROUND OF THE INVENTION

In U.S. Pat. No. 4,384,429 (ROKICKI et al, May 24, 1983) a sliding door arrangement is disclosed in which, when the door is being closed, the door panel moves bodily laterally, i.e. forwardly, with respect to the door slide track. A recess is provided into which the door panel is entered as the door becomes fully closed.

This arrangement has marked advantages, particularly as regards the ease with which the door may be provided with a very reliable weather seal—an aspect which is discussed in the aforesaid patent. The present invention represents an improvement to this kind of sliding patio door, i.e. the kind in which the door moves bodily forwardly into a recess.

BRIEF DESCRIPTION OF THE INVENTION

In the arrangement of the present invention, the door panel is mounted on a pair of crank arms which are capable of pivoting with respect to the door. The two crank arms are linked together so that when one pivots the other pivots in unison with it. In the aforesaid patent, the crank arms pivot both in the same sense, i.e. both clockwise or both counter-clockwise. In the present invention, the two crank arms are linked together in such a manner that they move in opposite senses.

The main benefit that arises from this reversing movement is that it assures that virtually no rearwardly directed force is experienced by the door when the door is being entered into the recess, against the resistance of the weather seal. The effect is that even a large, heavy, high quality, door can be moved to the closed position, and the weather seal can be firmly compressed, even though the person operating the door is applying only quite light forces to the door.

This benefit of the present invention will be described more fully in the description of a preferred embodiment of the invention, which follows below.

A preferred feature of the present invention is that the two crank arms lie at right angles to the line of the slide track when the door is fully entered into the recess, ie. when the door is in its fully closed position. The benefits attributable to this feature again will become plain from the description of a preferred embodiment, which follows below.

BRIEF DESCRIPTION OF THE DRAWINGS

The invention is described below in association with the accompanying drawings in which.

DETAILED DESCRIPTION OF PREFERRED EMBODIMENTS

Figure 1:
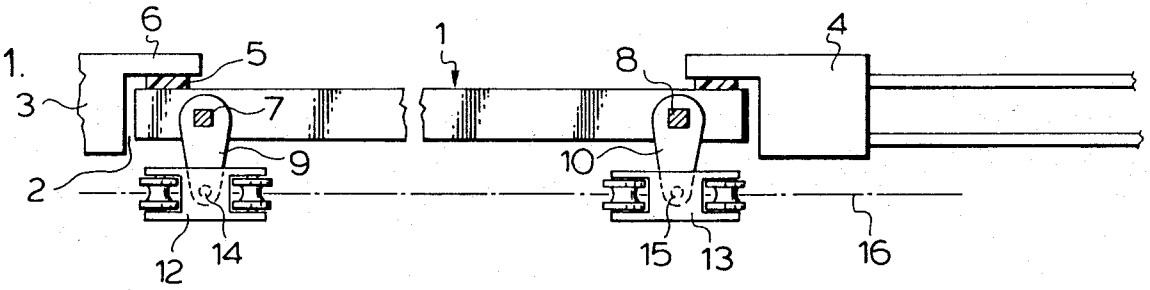
FIG. 1 is a view looking upwards from underneath a sliding door, when the door is in a recess.

In the Figures, a sliding door panel 1 is arranged to fit in a recess 2 defined between a fixed jamb 3 and a fixed mullion 4. When the door 1 is fully entered into the recess 2, a weather seal in the form of a rubber gasket 5 or other elastomeric seal is compressed between the door 1 and a lip 6 which extends completely around the recess 2.

Two crank shafts 7 and 8 run the height of the door 1. To the foot of each crank shaft 7 and 8 there is fixed a respective crank arm 9 or 10.

Each of crank arms 9 and 10 is supported upon a respective trolley 12 or 13, to which the respective crank arm 9 or 10 is connected by a pivot pin 14 or 15.

Each trolley 12 and 13 runs on wheels on a slide track 16. The weight of the door 1 rests on the crank arms 9 and 10, through which in turn the weight rests on the trolleys 12 and 13, and from there, through the trolley wheels, the weight of the door 1 rests on the slide track 16.

Figure 2:
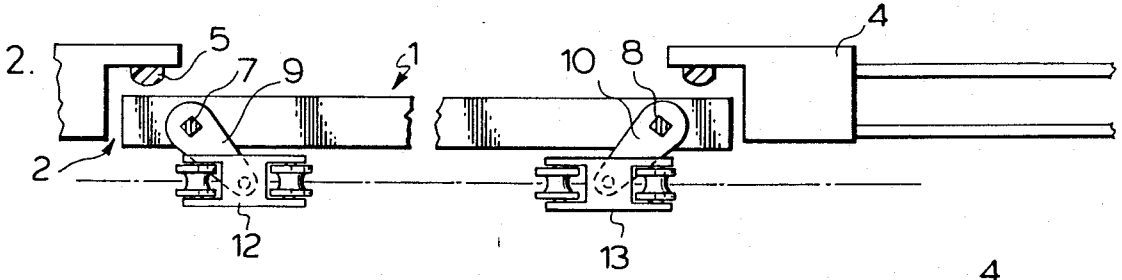
FIG. 2 is a view corresponding to that of FIG. 1, the door being shown slightly out of the recess.

The trolleys 12 and 13 are free to slide independently of each other along the slide track 16. When the crank arms 9 and 10 are rotated, in the manner as shown in FIG. 2, the two trolleys 12 and 13 start to approach each other by sliding along the slide track 16. Since the trolleys 12 and 13 cannot move rearwardly with respect to the slide track 16 and the door panel, the door 1 therefore starts to move out of the recess 2.

Figure 3:
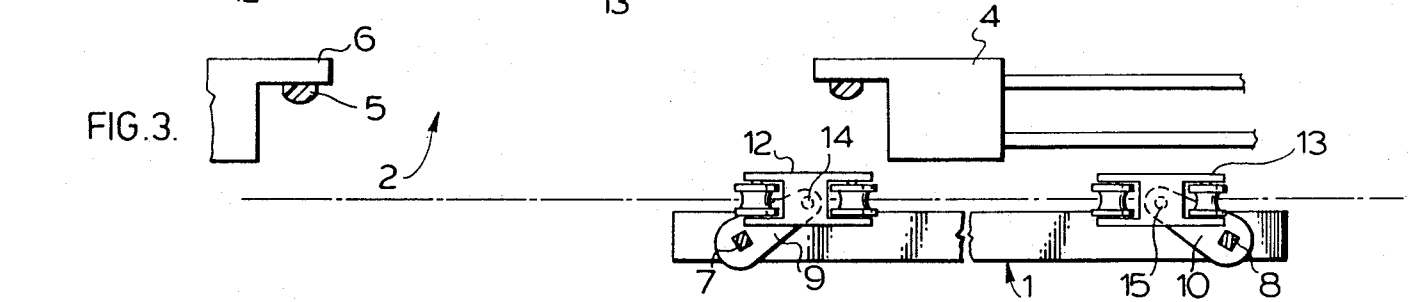
FIG. 3 is a view again corresponding to that of FIG. 1, with the door fully out of the recess and slid to its open position.

As shown in FIG. 3, further rotation of the crank shafts 7 and 8 causes the door 1 to move fully out of the recess 2, after which the door 1 may be easily slid sideways along the slide-track 16 to the fully open position.

When it is desired to close the door 1, the door is first slid sideways along the slide track to a position alongside the recess 2—as suggested by reference to FIG. 2; then the crank shafts 7 and 8 are rotated to force the door 1 outwards—i.e., forwardly—into the recess 2.

It is at this point that the main benefit of the reversing-drive arrangement for the crank arms, according to the present invention, can be recognised.

The weather seal 5 has to be compressed to a substantial degree if it is to provide a reliable seal against the weather over a long service life. In the present invention, as the force on the seal rises (ie. as the seal becomes almost fully compressed) the force on the seal is reacted through the crank arms 9 and 10. If the crank arms 9 and 10 were both to be inclined in the same sense at this time (as they are in the ROKICKI et al patent, for example), then there would be a net sideways component of that reaction acting on the door. Either the user would have to provide a force to counter that sideways force component by his or her own efforts, or the door could scrape against the jamb or mullion.

In the present invention, on the other hand, the crank arms rotate in opposite senses; and by that arrangement there is no net sideways component in the reaction to the forwardly directed seal compressing force.

Figure 4:
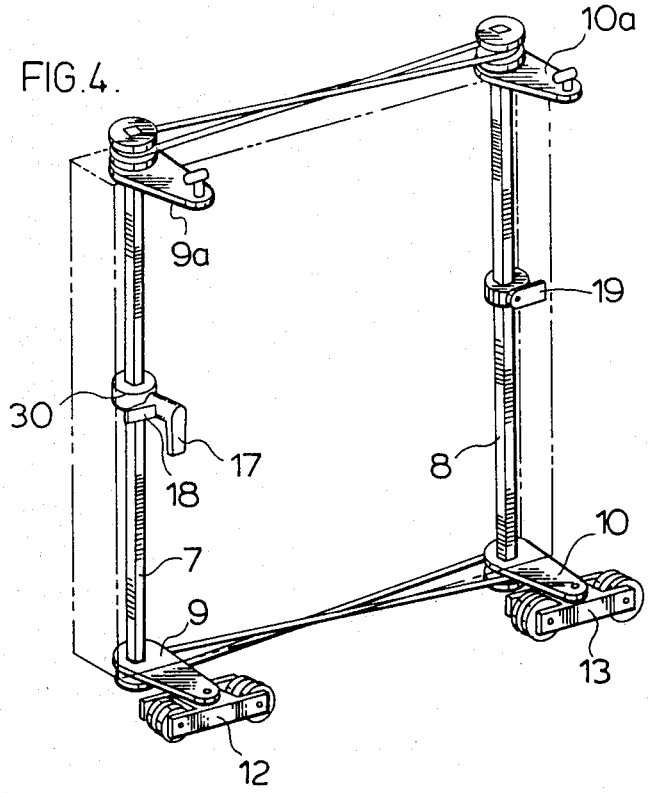
FIG. 4 is a diagrammatic view of a sliding door in the fully closed position.

Obviously, as shown in FIG. 4, for the best arrangement and for the easiest operation of the door, a further slide track will be arranged at the top of the door, having further trolleys or other slide means, and with further crank arms 9*a* and 10*a* secured at the top of the respective crank shafts 7 and 8.

Referring also to FIG. 4, which is diagrammatic as to this immediate discussion, it is seen that a handle 17 is connected to the crank shaft 7 by such means as a bevel gear 30, so that the crank shaft 7 rotates when the handle 17 is turned. A latch bar 18 swings into a complementary slot in the jamb 3 also when the handle 17 is turned. Similarly, a corresponding latch bar 19 also swings into a slot in the mullion 4 when the handle 17 is turned. The mechanisms by which the respective jamb lock and mullion lock latch bars 18 and 19 are moved into and out of their locking positions may be such as those that are disclosed in co-pending application, Ser. No. 870953 filed, 06/05/86 and incorporated herein by reference.

At the same time, the crank shafts 7 and 8 are each coaxial with the respective door frame pivot axes of the crank arms 9 and 10. The crank arms are each fixed, as to their pivoting capabilities, to the respective crank shafts. Thus, the action of turning the door handle 17 is effective to rotate the respective crank shaft 7, and with it the respective crank arm 9 which is pivoted about the axis of the crank shaft. Moreover, the driving action by which the crank shaft 7 is rotated in one sense (clockwise or counter-clockwise) is effective through the reverse drive means—particularly as discussed hereafter with reference to FIGS. 5 and 6—to rotate the other crank shaft 8 in the opposite sense (i.e., counter-clockwise or clockwise).

A preferred feature of the present invention is that the crank arms 9 and 10 each lie at a right angle to the slide track 16 when the door 1 is fully entered into the recess 2. This feature is clearly shown in FIGS. 1 and 4. The longitudinal axis of each of the crank arms 9 and 10 is seen from those Figures as being a line which joins the two pivot axes, one at each end, of that respective crank arm. Thus, the longitudinal axes of the crank arms 9 and 10 lie at right angles to the slide track 16 when the door 1 is in its closed door position in the door recess 2.

Patio doors are usually very large, heavy, and cumbersome items. Even though the frame of the door may be of lightweight plastic or aluminum, the quality of the door is measured by the thickness and weight of the glass used in the door.

Usually, sliding door manufacturers design their products so that relatively substantial force is required to compress the weather seal, which force must be provided by the user of the door, so that the door must be closed with some degree of emphasis. In this manner, the impact of the moving door is used to achieve the large force needed to compress the seal. However, the manufacturer of high quality doors wishes to avoid the need for the user to have to hurl a heavy door into the recess, simply in order to get enough compressive force on the weather seal.

It will be noted that as the seal 5 is becoming fully compressed, the crank arms 9 and 10 are starting to reach the orientation where their longitudinal axes lie at right angles to the slide track 16. This is the orientation where the crank arms have the maximum mechanical advantage as regards compressing the seal 5. With the present invention therefore, even a very heavy, top quality, door 1 can be closed into the recess 2 by the user of the door simply carrying out the operation of gently turning the handle 17. The unseemly hurling of the door, or the need to lean one's weight against the door, to get the door to compress the seal, is avoided. Even so, the force with which the seal 5 is compressed is quite as strong as is needed to give a good weather-tight seal.

Another advantage arises from the fact that each of the crank arms 9 and 10 lies at a right angle to the slide track 16, and that is that the door is very secure against being forced from the locked position. It will be seen from FIG. 1 that even the act of inserting a crow bar between the door 1 and the lip 6 will simply load the crank arms in compression. Naturally, any component will break if it is stressed violently enough, but the fact that the crank arm stays in place until something does break makes the arrangement very secure.

Sliding patio doors are generally much taller than they are wide. This can mean that the compression force against the weather seal may tend to slacken off in the middle of the height of the door if the door has even only a slight capability to bow inwardly. It will be seen by the arrangement as shown in FIG. 4 that a door according to the present invention, having the latch-bars 18 and 19 will, when the latch-bars are engaged with the respective jamb or mullion, resist any tendency of the door to bow inwards.

Figure 5:
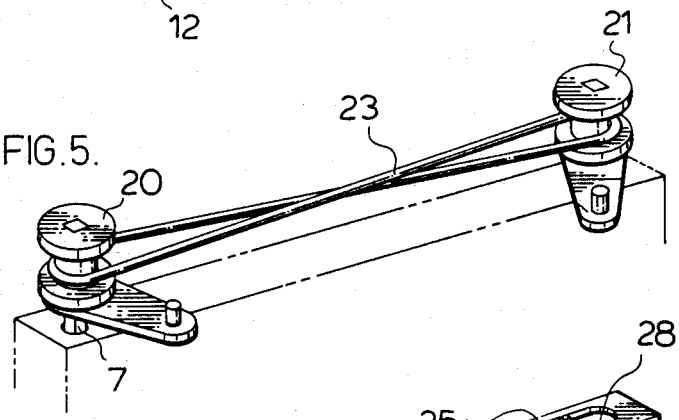
FIGS. 5 and 6 are pictorial views of two means for constraining the crank arms to rotate in opposite senses.

In FIG. 5, the crank shafts 7 and 8 are shown to be each fitted with a respective pulley 20 or 21. A cord 23 is stretched between the pulleys 20 and 21 in a figure-of-eight configuration. Thus, when one crank shaft 7 rotates clockwise, the other crank shaft 8 is constrained to rotate counter-clockwise.

Figure 6:
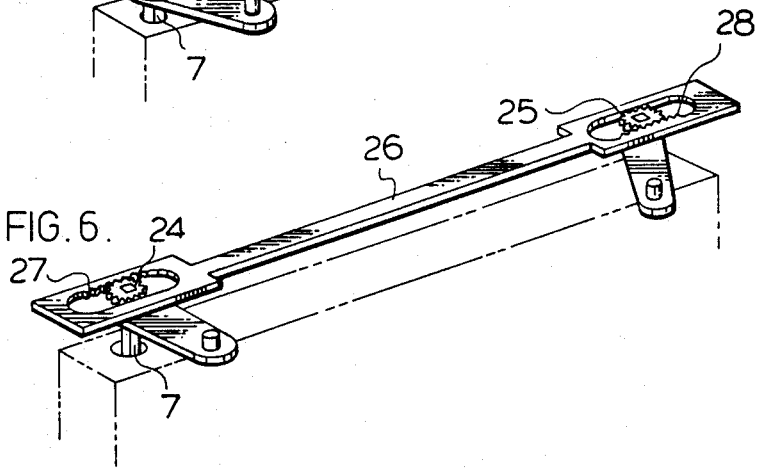

In the FIG. 6 embodiment of the present invention, the two crank shafts 7 and 8 are fitted with respective pinions 24 and 25. A connecting link 26 has racks 27 and 28, the teeth of which engage with the pinions 24 and 25. The reversing capability provided by in the present invention is assured by the fact that the teeth of the racks 27 and 28 face in opposite directions.

I claim:

1. Sliding door arrangement, comprising a door, a door receiving recess, a fixed slide track, a pair of trolleys, a pair of crank arms, and an elastomeric seal;

said door having a door frame, and a rotatable door handle mounted to one side of the door frame substantially mid way of the height thereof;

said elastomeric seal being interposed between a portion of said door receiving recess and said door frame in compressed sealing relation therebetween when said door is fully entered into said recess;

each crank arm of said pair of crank arms being mounted for pivoting about a respective vertical pivot axis;

each said vertical pivot axis being located within the frame of the door;

wherein each crank arm is mounted for pivoting with respect to a respective trolley;

said trolleys being arranged for displacement along the slide track;

said door being arranged to move horizontally at right angles to the direction of said slide track, when entering or leaving said door receiving recess;

said two crank arms being in operative engagement with said door handle, and being arranged to pivot in response to a turning action of the door handle;

the action of pivoting the crank arms being such as to bodily displace said door at right angles to the slide track, so as to move the door into and out of said recess;

said elastomeric seal sealingly engaging the periphery of the door when the door is fully entered into said door receiving recess;

wherein the mechanical advantage provided by the crank arms when displacing the door inwardly into the recess, being at right angles to said slide track, achieves a maximum value in compressing the elastomeric seal, in the fully closed position;

and wherein said two crank arms are arranged to rotate in opposite senses, one clockwise and one counter clockwise, when said door handle turns.

2. Sliding door arrangement of claim 1, where the weight of the door is supported through the crank arms and the trolleys by said slide track.

3. Sliding door arrangement of claim 2, where said slide track, trolleys, and crank arms are positioned at the bottom of the door; and where a corresponding further slide track, and corresponding further trolleys and crank arms, are positioned at the top of the door.

4. Sliding door arrangement of claim 2, where each trolley runs on wheels.

5. Sliding door arrangement of claim 1, where the means for arranging the crank arms to move in opposite senses comprises a reverse drive means.

6. Sliding door arrangement of claim 5, where the reverse drive means comprises respective pulleys, one on each of the crank arms, in combination with a cord which engages the pulleys; and where the cord is crossed in a figure-of-eight manner between the pulleys.

7. Sliding door arrangement of claim 5 where the reverse drive means comprises respective pinions, one on each of the crank arms, in combination with a connecting link on which are provided two racks;

where the racks respectively engage the pinions;

and where the rack teeth of one rack face in the opposite direction to that of the rack teeth of the other rack.

8. Sliding door arrangement of claim 5, where a crank shaft is provided co-axially with the door frame pivot axis of one of the crank arms and is fixed as regards pivoting to that crank arm;

where the action of turning the door handle is effective to rotate the crank shaft and that crank arm together;

and where the reverse drive means is effective to rotate the other crank arm in unison, but in the opposite sense.

9. Sliding door arrangement of claim 1, where the longitudinal axis of each of said crank arms is a line joining the two pivot axes of that crank arm;

and where the arrangement is such that the longitudinal axes of the two crank arms both lie substantially at right angles to the slide track when the door is in the recess.

10. Sliding door arrangement of claim 1, where latch bars are positioned substantially mid way of the height of the door, one at each side of the door in pivotally mounted relation, to swing pivotally into a respective slot and engage the respective door jamb and mullion where the door is closed, upon rotation of said door handle to a latched condition, to resist any tendency of the door to bow and to maintain said elastomeric seal effective to seal the full height of the door.

* * * * *